United States Patent [19]

Knable

[11] 4,413,549

[45] Nov. 8, 1983

[54] LIMIT SWITCH ACTUATOR FOR FLUID CYLINDERS

[75] Inventor: Raymond J. Knable, Elmhurst, Ill.

[73] Assignee: Parker-Hannifin Corporation, Cleveland, Ohio

[21] Appl. No.: 274,940

[22] Filed: Jun. 18, 1981

[51] Int. Cl.[3] ..... F01B 31/12

[52] U.S. Cl. ..... 92/5 R; 92/162 P; 200/82 C; 200/153 LA

[58] Field of Search ..... 91/1; 92/5 R, 162 R, 92/162 P, 165 PR; 200/82 C, 153 LA, 153 LB; 403/328, 383; 60/534, 535, 561

[56] References Cited

U.S. PATENT DOCUMENTS

| | | | |
|---|---|---|---|
| 2,833,602 | 6/1958 | Bayer | 92/162 R |
| 3,414,693 | 12/1968 | Watson et al. | 92/5 R |
| 3,661,053 | 6/1972 | Rich | 91/394 |
| 3,670,122 | 6/1972 | Belart et al. | 200/153 LA |
| 4,040,338 | 8/1977 | Wilson et al. | 91/1 |
| 4,070,644 | 1/1978 | Shellhause | 60/534 |

*Primary Examiner*—Robert E. Garrett
*Assistant Examiner*—Richard S. Meyer
*Attorney, Agent, or Firm*—Joseph B. Balazs

[57] ABSTRACT

An actuator mechanism for detecting the presence of the piston or other movable element of a fluid cylinder for reversing switch purposes and the like is disposed in the end cap of the cylinder and is engaged by the cushion spear on the piston to provide transverse linear motion for actuation of a microswitch. The mechanism consists of a slender rod supported for movement transverse to the motion of the piston, the rod having a shoe at its lower end which receives a plunger, the latter passing through a bore in the end cap and adapted to be cammed upwardly by engagement with the cushion spear. The shoe and plunger are spring-biased toward the piston and the upward movement against the bias serves to actuate a microswitch external of the end cap to signal the presence of the piston. In a design suitable for different size cylinders, the plunger is formed of square stock of appropriate length. Rounded corners of the plunger stock at both ends provide a slidable supportive engagement in a bore in the adapter shoe and in the end cap bore and assure fluid communication through the lower bore to prevent pressure-induced, false actuations.

4 Claims, 4 Drawing Figures

LIMIT SWITCH ACTUATOR FOR FLUID CYLINDERS

BACKGROUND OF THE INVENTION

Radially movable switch actuating rods which are engaged by the piston of a fluid cylinder as the piston approaches the end of its stroke are known in the art, but have deficiencies which have prevented the realization of a reliable mechanism. For example, such actuator devices are subject to an appreciable amount of side loading upon engagement with the piston. One way to accommodate such forces is to use a large diameter rod and closely support same in a guide bore. Since the rod is subject at one end to fluid pressure within the cylinder, high fluid pressure forces are encountered and a relatively stiff return spring must be utilized to prevent false actuations due to transient fluid pressures and the like. Friction effects of a large diameter rod are also of concern, affecting not only the reciprocating movement of the actuator rod but also any rotary movement within its guide bore. The rotary motion is useful in spreading the wear on the tip of the actuator plunger so that a longer life can be achieved with this part. Further, the larger sized rod requires a large seal which provides greater potential for friction and leakage problems.

An alternative arrangement is to use a slender actuator rod and some form of joint to eliminate or minimize side loads. Friction forces on the small rod are minimal and do not appreciably affect the linear or rotary movement of the rod. Because of this, a lighter return spring may also be used, reducing also the force at the plunger tip to alleviate to some extent the wear problem which occurs there.

One such prior art arrangement is shown in U.S. Pat. No. 3,661,053 wherein a slender rod actuator is combined with a ball plunger. The ball plunger eliminates side load effects on the rod and as it is free to rotate within its guide bore, distributes wear about the surface of the ball. This particular design, however, is subject to false actuations, possibly due to fouling of passages which transmit fluid cylinder pressures to prevent pressure unbalance upon the actuator and possibly due to clogging in the guide arrangement for the ball wherein the periphery of the ball is closely restrained. Further, in this design, a ball and matching ball race are required and this presents special design considerations for different size cylinders or where different cushion spears are used or where different pressure levels are encountered. Sizing the ball and race accordingly presents design considerations which are inconvenient and difficult to control on a mass-production basis.

SUMMARY OF THE INVENTION

These problems are alleviated to a great extent in the instant invention in which a relatively slender actuating rod is utilized to reduce the fluid pressure forces acting thereon so that a relatively light return spring may be employed, helping to alleviate undue wear on the plunger tip. The actuator rod is guided at the lower portion thereof by a plunger which passes through a bore in the housing to be positioned in the path of travel of the piston rod of the fluid cylinder. Upon engagement therewith the plunger is cammed in a direction transverse of the path of movement of the piston. The plunger is preferably formed of square cross section material with the corners rounded at the upper and lower ends. This forms a rounded guide for the plunger in the lower end thereof with flats to assure large passages for fluid transmission and pressure balance. The rounded portion at the upper end is received in a stop bore in an actuator shoe fixed to the actuator rod. Relative rotary movement is provided between the plunger and the actuator shoe by a slip fit while the actuator rod itself is relatively free to rotate because of its relatively slender configuration which has low friction and fluid pressure forces acting thereon. A further feature of this invention is the accommodation of many different sizes and types of fluid cylinders by means of common elements of the actuator, requiring essentially, only the sizing of the overall length of the plunger and the length of the rounded corners at either end thereof.

BRIEF DESCRIPTION OF THE INVENTION

Figure 1:
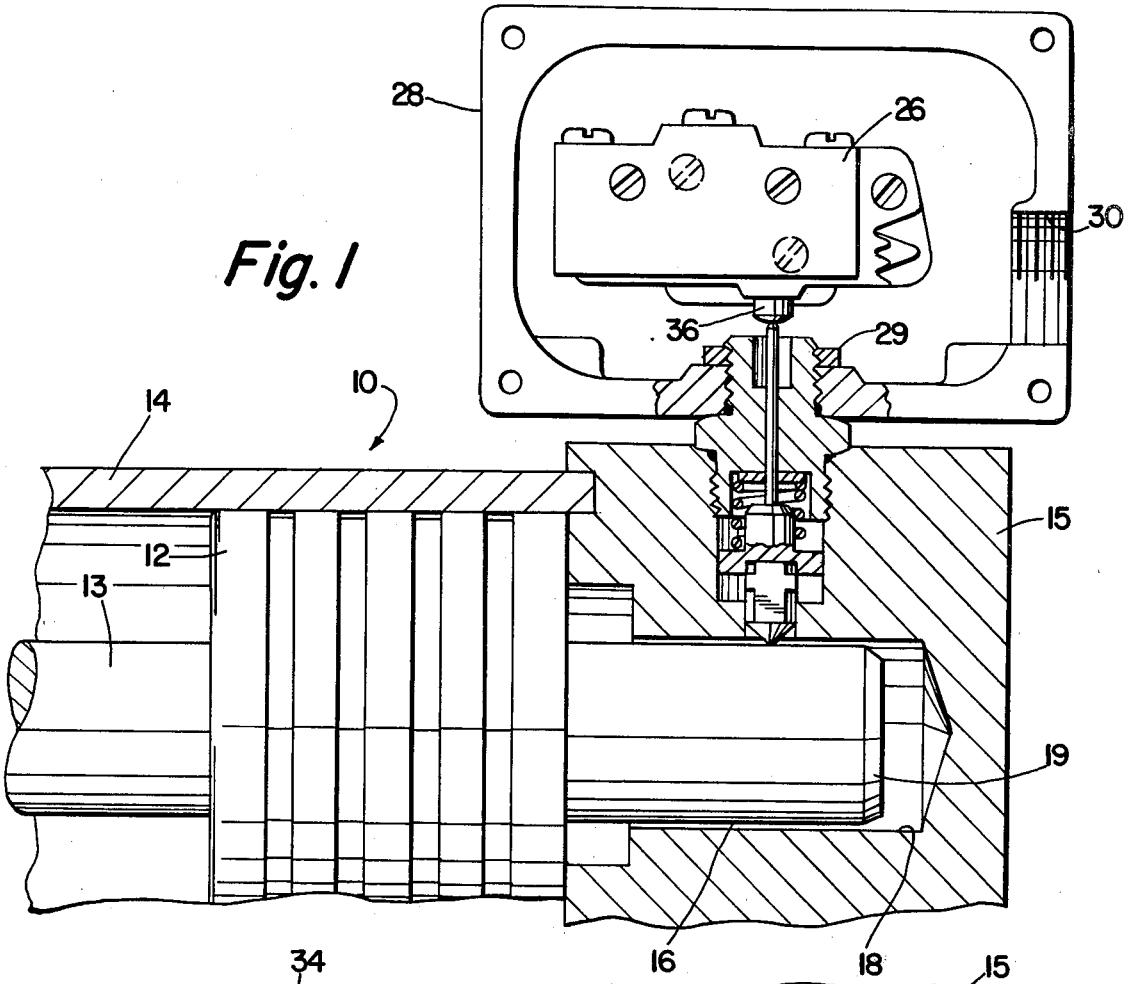
FIG. 1 is a partial cross-section view of the end cap and one end of a fluid cylinder illustrating the limit switch actuator in conjunction with a microswitch and in the actuated position.

Referring now to the drawings there is shown a portion of a fluid cylinder 10 which consists of a piston 12 supported for reciprocating movement on piston rod 13 within tubular cylinder 14, the latter being closed by end cap 15. A cushion spear 16 is mounted on piston 12 for movement therewith and is received in stop bore 18 in the end cap 15 and includes a bevel end 19 thereon. The cushion spear 16 acts in a manner well known in the art, to cushion the end limits of movement of the piston 12, by controllably compressing fluid in stop bore 18 and a similar cushion may be employed as well at the head end of fluid cylinder 10.

End cap 15 is a cylindrical block and includes transverse bore 20 which intersects with cushion bore 18, and counterbore 21 which terminates at shoulder 22 at its inner end adjacent cushion spear 16. Counterbore 21 is threaded at its outer end and receives therein a body member fitting 24 which is sealed to end cap 15 by o-ring 25, forming a chamber 23.

Body member 24 is a support for the actuator mechanism therein as well as for microswitch 26, the latter being secured to switch housing 28, in turn mounted at the outer portion of body member 24 and secured by nut 29. The housing 28 is a junction box for electrical connection with external circuitry and includes a conduit connection aperture 30 for this purpose. While a SPDT microswitch 26 is indicated, it is apparent that many different types of switches, housings and the like may be utilized within the teachings of this invention.

Figure 2:
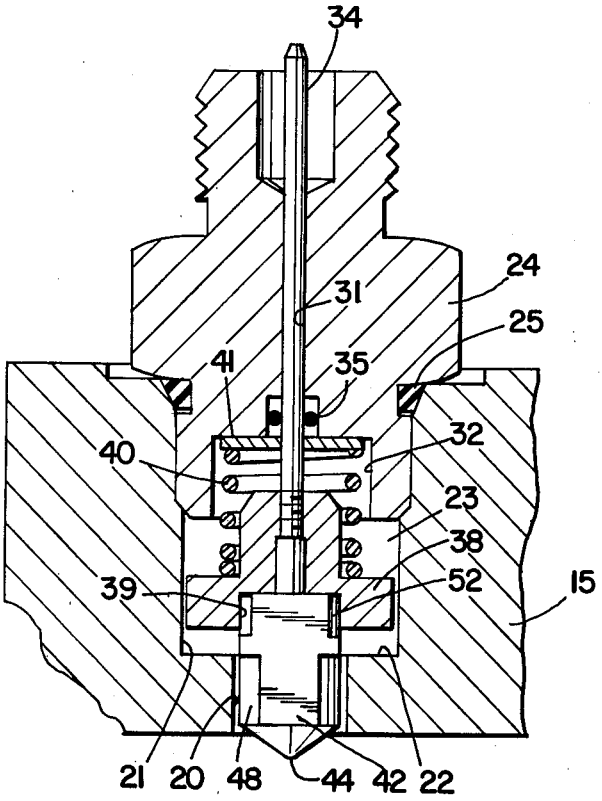
FIG. 2 is an enlarged cross-sectional view of the actuator of FIG. 1, with parts removed, showing the device in the non-actuated position.

The actuator mechanism may be seen in more detail in FIG. 2 in support within body member 24, the latter including a central bore 31 and counterbore 32 at the inner portion thereof. A slender actuator rod 34 is slidably received in bore 31 for both linear and rotary movement and is sealed at lower end by o-ring 35. Actuator rod 34 is of sufficient length to extend from lower counterbore 32 outwardly of body member 24 into engagement with the movable pushbutton 36 of microswitch 26 for actuation of the latter. Actuator rod 34 is threaded at its inner end and supports thereon actuator shoe 38, the latter being a generally cylindrical member formed of square stock having rounded corners for a sliding fit in bore 21 and having stop bore 39 in the lower face thereof. Actuator shoe 38 is biased inwardly toward cushion spear 16, by means of spring 40 acting between a shoulder on shoe 38 and backup washer 41 disposed in the bottom of counterbore 32 in body member 24.

Figure 3:
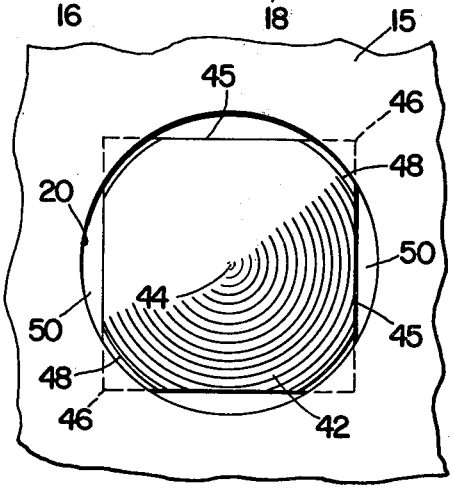
FIG. 3 is a still further enlarged fragmentary bottom view of the actuator and end cap of FIG. 2.

Plunger 42 is received within stop bore 39 of actuator shoe 38 and is biased therewith by spring 40 inwardly toward cushion spear 16. Plunger 42 is a metal rod of square cross-section, seen most clearly in FIG. 3, and is of sufficient length to extend from actuator shoe 38, through end cap transverse bore 20, into end cap bore 18 to a position in the path of travel of cushion spear 16. Plunger 42 terminates at its inner end in conical tip 44 which is adapted to be engaged by bevel 19 on cushion spear 16 as the latter enters bore 18 to cam the plunger 42, actuator shoe 38 and rod 34 outwardly to the position depicted in FIG. 1, to depress button 36 and actuate microswitch 26. Plunger 42 rides on the cylindrical periphery of cushion spear 16 and is maintained in this outward position when the cushion spear is thus entered into bore 18. As piston 12 is moved to the opposite end of cylinder 14, cushion spear 16 is withdrawn from bore 18 and the actuator mechanism is moved to its innermost position, shown in FIG. 2, under the urging of spring 40 and any spring action inherent within microswitch 26.

Again referring to FIG. 3, plunger 42 comprises four flat sides 45 intersecting in corners 46. At the inner end of plunger 42, the corners 46 are rounded to form arcs 48 such tht the diametral dimension between arcs 48 is slightly less than the diameter of transverse bore 20 so that plunger 42 is guided within bore 20 during its inward and outward movement. The sides 45 are dimensioned so that the corners 46 extend radially outwardly of bore 20, forming a shoulder to interfere with end cap shoulder 22 to prevent plunger 42 from being biased any further inwardly than the position depicted in FIG. 2. Sides 45 are dimensioned, however, so that opposite corners 46 extend only slightly outwardly of bore 20 so that relatively large flow paths 50 are formed between the sides 45 and bore 20 to provide sufficient fluid communication between counterbore 21 and end cap bore 18. Movement of plunger 42 in bore 20 tends to maintain flow paths 50 open and free of contamination which might affect the operation of the actuator mechanism.

At the outer end of plunger 42, corners 46 are also rounded to form arcs 52 which are dimensioned to provide a sliding fit in stop bore 39 of actuator shoe 38. Plunger 42 is thus able to rotate in shoe 38, and in being guided in bore 20, is limited to linear motion and provides lateral support for actuator rod 34.

Figure 4:
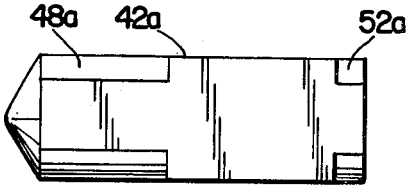
FIG. 4 is a side view of another form of actuator plunger of the invention.

FIG. 4 depicts another embodiment of plunger **42*a* suited for use in this invention, this plunger however, being dimensioned for another piston and cylinder application. Plunger 42*a* differs from plunger 42 essentially only in the length of same and the length of inner rounded corners 48*a* and outer rounded corners 52*a* which perform the same functions as those previously described, i.e., providing a guide in transverse bore 20 and a seat in stop bore 39 of actuator shoe 38. By using a common cross-section size for plungers 42, 42*a*, the size of bore 20** may be kept consistent in other design configurations, as can the remainder of the components forming the actuator mechanism.

What is claimed is:

1. In combination with a fluid cylinder, a switch assembly for detecting the position of the piston or other movable element of the fluid cylinder, comprising a housing at one end of said cylinder in which said movable element reciprocates under control of fluid pressure, said housing having a bore therein transversely oriented with respect to the path of movement of said movable element and a counterbore, an actuator body member sealingly engaged in said counterbore forming a chamber with said housing in fluid communication with the interior of said fluid cylinder, said body member having a central bore therein transverse to the path of movement of said movable element, switch means mounted on said body member, an actuator rod slidably received in said central bore of said body member for actuating said switch means, said actuator rod being engageable at the outer end thereof with said switch means, means sealing said actuator rod, an actuator shoe fixed to the inner end of said actuator rod for movement therewith, said shoe having a central stop bore therein, means biasing said actuator shoe away from said body member, and a plunger received in said stop bore and guided in said housing bore, said plunger extending from said chamber through said housing bore and into the path of movement of said movable element, said plunger having a conical tip thereon for engagement with said movable element to move said plunger in said housing bore and to move said actuator shoe and rod for actuation of said switch means, said plunger having a shoulder thereon larger than the diameter of said housing bore for retaining said plunger within said chamber, said plunger having means at its periphery between said conical tip and said shoulder forming a fluid path between the interior of said fluid cylinder and said chamber for preventing fluid pressure unbalance on said plunger and for guiding said plunger for linear movement in said housing bore, said plunger means comprising alternate first and second surfaces distributed about the periphery of said plunger, said first surfaces on said plunger being spaced from said housing bore to form fluid paths, and said second surfaces intersecting said first surfaces closely adjacent said housing bore to form guides for limiting movement of said plunger linearly of said housing bore.

2. The combination set forth in claim 1 wherein said second surfaces comprise arc surfaces having a diameter closely conforming to the diameter of said housing bore and said first surfaces comprise flat surfaces disposed between each of said arc surfaces.

3. The combination set forth in claim 1 wherein said plunger is formed of square-section stock having rounded corners at one end thereof for guiding said plunger within said body member bore.

4. The combination set forth in claim 3 wherein said plunger further comprises rounded corners at the other end thereof for slidably supporting said plunger in said stop bore of said actuator shoe.

* * * * *